United States Patent [19]

Hertel

[11] 4,029,046

[45] June 14, 1977

[54] SKI HOT WAX APPLICATOR

[76] Inventor: Terry J. Hertel, 20065 Northwind Square, Cupertino, Calif. 95014

[22] Filed: Nov. 13, 1975

[21] Appl. No.: 631,552

Related U.S. Application Data

[63] Continuation of Ser. No. 459,492, April 10, 1974, abandoned.

[52] U.S. Cl. ..... 118/202; 118/258

[51] Int. Cl.[2] ..... B05C 1/02

[58] Field of Search ..... 118/202, 258, 72, 13, 118/5, 259

[56] References Cited

UNITED STATES PATENTS

| | | | |
|---|---|---|---|
| 1,979,436 | 11/1934 | Bedford | 118/13 |
| 2,396,946 | 3/1946 | Grupe | 118/202 X |
| 2,781,278 | 2/1957 | Harmon | 118/202 X |
| 3,389,684 | 6/1968 | Talbot | 118/202 |
| 3,448,718 | 6/1969 | Green et al. | 118/19 X |
| 3,464,381 | 9/1969 | Rey | 118/202 |
| 3,752,114 | 8/1973 | Knight | 118/202 X |
| 3,782,330 | 1/1974 | Kanda | 118/202 X |
| 3,788,270 | 1/1974 | Blair | 118/5 |
| 3,828,724 | 8/1974 | Korodi | 118/258 |

FOREIGN PATENTS OR APPLICATIONS

| | | | |
|---|---|---|---|
| 579,854 | 8/1946 | United Kingdom | 118/202 |

*Primary Examiner*—John P. McIntosh
*Attorney, Agent, or Firm*—David A. Boone

[57] ABSTRACT

Apparatus for the controlled hot waxing of skis is disclosed. The apparatus includes an upwardly opening semi-cylindrical tub with closed ends. The tub is constructed of heat conductive material, and a heater is mounted on the exterior radial surface of the tub so that wax placed therein will be caused to melt at the appropriate temperature. A solid aluminum roller having axial struts projecting from the opposite ends thereof is rotatably mounted on the closed ends of the cylinder so that the lower portion of the roller will project into the melted wax and the upper portion of the roller will provide an exposed surface for contact with a ski. The roller and struts are of heat conductive material so that heat from the end walls of the tub is conducted through the struts to the roller. A covering is applied to the radial surface of the roller and has a preselected softness so that a ski passing over the covering will remain in full contact with the covering over the entire width of the ski. The surface of the roller is maintained at a temperature which is adapted to open the pores in the bottom of the ski so that the hot wax is applied uniformly and firmly adheres to the bottom of the ski.

6 Claims, 3 Drawing Figures

SKI HOT WAX APPLICATOR

This is a continuation of application Ser. No. 459,492, filed Apr. 10, 1974, now abandoned.

BACKGROUND OF THE INVENTION

The present invention relates to hot waxing apparatus, and in particular to an apparatus for hot waxing a ski such as downhill and cross-country snow skis.

The application of heated and melted wax, called hot wax, is theoretically far superior to cold wax in improving the performance of skis. Hot wax adheres to the skis better than the cold wax, and the melted wax can be more readily uniformly applied to the ski. However, in practice, the theoretical advantages of hot waxing have not been fully realized because existing apparatus used in hot waxing does not take advantage of applying the wax uniformly. Difficulty has been encountered in uniformly heating the wax to the appropriate temperature, i.e., a temperature which is sufficient to melt the wax but does not alter its chemical properties. Also, one of the essential features of hot waxing is to heat the bottom of the ski so that the pores therein are opened and receive the wax, and difficulty has been encountered in heating the bottoms of the skis to the proper temperature so that the pores open fully. If the bottoms of the skis are overheated, which often happens when an iron is used to heat the skis, internal bonds in the skis will be damaged and the skis may delaminate. Furthermore, apparatus presently available for hot waxing does not always uniformly apply the wax across the entire width of the ski and therefore does not achieve a continuous, smooth waxed surface. These problems all decrease the effectiveness of the hot waxing so that the theoretical advantages of hot waxing are not fully realized.

SUMMARY OF THE INVENTION

The present invention provides apparatus for the controlled hot waxing of skis. The apparatus includes an upwardly opening, semi-cylindrical tube with closed ends. The tub is constructed of heat conductive material and a two-dimensional heater is mounted on the exterior radial surface along the length of the tub so that wax placed in the tub is melted and maintained at the appropriate temperature. The heating is controlled so that the wax is melted but is not heated to a sufficient degree to alter its chemical properties which would reduce the effectiveness of the wax. If the wax is overheated, synthetic ingredients in the wax, which are quite volatile, will vaporize and the chemical composition of the wax will change. The two-dimensional heater is wrapped around the exterior surface of the tub so that all of the wax is heated uniformly. This avoids the formation of hot spots which could alter the chemical properties of the wax, and insures that the viscosity of the wax is reduced sufficiently so that it can be uniformly applied.

A roller having axial struts projecting from the opposite ends rotatably mounts to the tub. The lower portion of the roller projects into the tub and the upper portion of the roller is exposed. The roller and struts are constructed of heat conductive material, preferably solid aluminum, so that heat from the end walls of the tub will be conducted through the struts to the roller and the roller is maintained at a constant temperature. A covering is mounted on the radial surface of the roller and has a preselected durometer rating (softness) to insure that a ski passing over the covering is in full contact with the covering over the entire width of the ski at all times. The thickness of the covering is selected so that the surface of the roller is maintained at a preselected temperature established to open the pores in the bottom of the ski as it moves along the roller. In this manner, hot wax from the tub is uniformly applied and firmly adheres to the bottom of the ski.

The primary object of the present invention is to control all of the various parameters in the application of hot wax so that the theoretical objectives of hot waxing are obtained. To this end, both heating of the wax and the heating of the bottom of the ski are closely controlled so that the chemical composition of the wax is not affected and it firmly adheres to the bottom of the skis. The skis are not overheated so there is no danger of the skis being damaged or destroyed. Also, the application of the melted wax is controlled so that a uniform layer of wax is applied. As a result, the theoretical objectives of hot waxing are not lost in the waxing operation and the performance of the skis is substantially improved.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
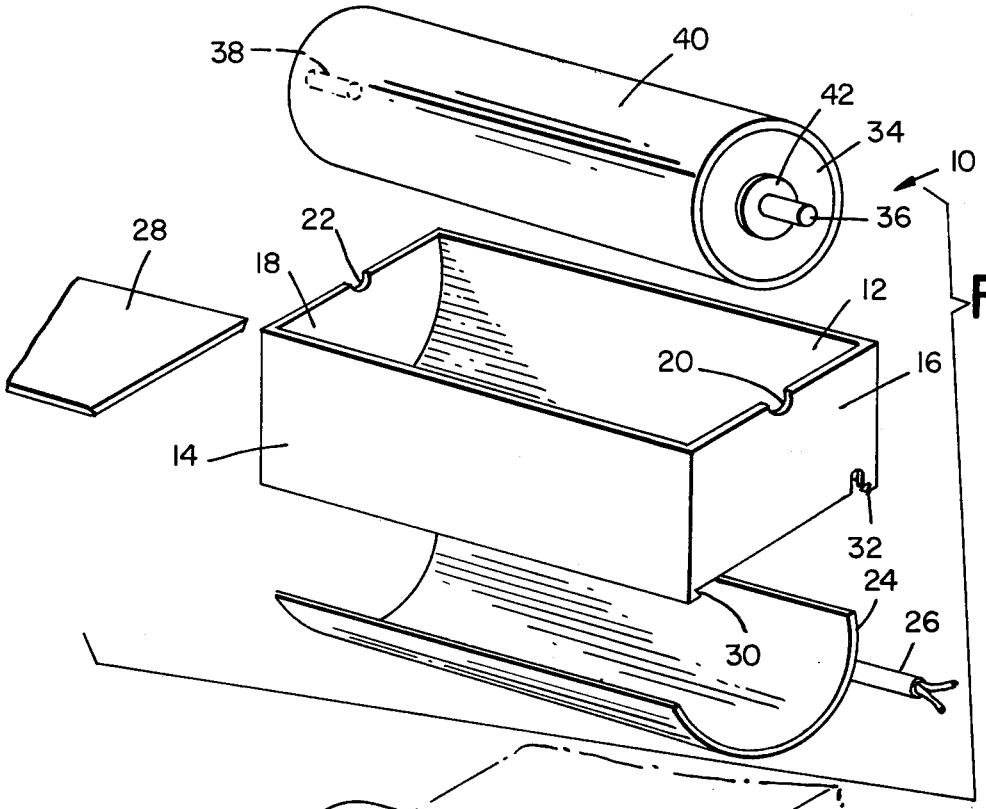
FIG. 1 is an exploded view of the hot waxing apparatus of the present invention.
Figure 2:
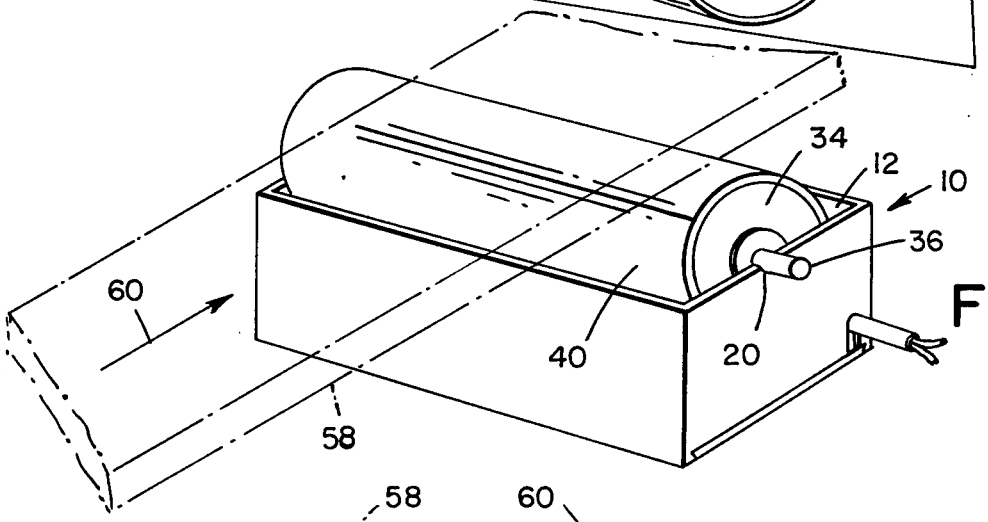
FIG. 2 is a perspective view of the hot waxing apparatus being used to apply wax to the bottom of the ski.

The elements of the hot waxing apparatus 10 of the present invention are illustrated by way of reference to FIGS. 1 and 2 in combination. Apparatus 10 includes a tub 12 wherein the wax is melted and maintained at an elevated temperature. The interior surface of tub 12 is coated with Teflon so that solidified wax can be easily removed after use of apparatus 10. Tub 12 is semi-cylindrical and is mounted in a rectangular frame 14. Tub 12 is closed at each end by planar walls 16, 18, each of which have slots 20, 22 formed in the upper surface thereof. Slots 20, 22 are offset from the central axis of tub 12 as will be further illustrated below. A two-dimensional heating sheet 24 is demountably attachable to the exterior radial surface of tub 12 and extends along virtually its entire length. Heating sheet 24 wraps around tub 12 as illustrated so that melted wax in the tub will be maintained at a uniform temperature. Heater 24 is powered by means of an electric cord 26. When heating sheet 24 is attached to the bottom of tub 12, a plate 28 is adapted to engage slots 30, 32 in the lower surface of frame 14 so that heating element 24 is enclosed during normal use of the apparatus 10.

A cylindrical roller 34 forms part of apparatus 10 and has oppositely directed axial struts 36, 38 projecting from each end. Roller 34 and struts 36, 38 are constructed of heat conductive material, roller 34 preferably being constructed of solid aluminum and having a diameter of 1¾ inch. Hence, heat from tub 12 is conducted to the interior of roller 34 by the contact of struts 36, 38 with slots 20, 22. Since the roller is solid, its temperature will be uniform. A covering 40 is provided on the radial surface of roller 34. Covering 40 is preferably silicone rubber, and the thickness and softness of covering 40 is preselected so that the covering will fully engage the entire lower surface of a ski which is moved across the roller. For a covering thickness of one-eighth inch, a durometer rating of 30–50 has been found satisfactory, with durometer ratings in the range of 40–45 inclusive being optimum.

The thickness of covering 40 is critical not only in providing the appropriate softness so that the entire ski is engaged but also in controlling the surface temperature of the covering which contacts the ski. Heater 24 is maintained at approximately 450° F., and heats the wax in tub 12 to a uniform temperature in the range of 250° to 300° F. with roller 34 in place (the roller must be in place or the wax will be overheated) to appropriately melt the wax. The wax will start to melt at approximately 140° F., and waxing can be initiated when the wax is fully melted. Use of the apparatus should be limited to approximately one hour to avoid overheating of the wax. The chemical properties of the wax will be altered and its performance substantially impeded if its temperature exceeds approximately 300° F., which could easily occur if hot spots were allowed to form due to uneven heating. A correspondingly lower temperature, in the range of 200° to 225° F., is optimum to open the pores in the bottom of the skis, and the thickness of covering 40 is selected so that the temperature on the outer surface thereof is substantially 200°–225° F. For a silicone rubber covering, the optimum thickness has been found to be one-eighth inch. In order to prevent covering 40 from contacting side walls 16, 18 of tub 12, raised shoulders such as 42 are provided on each side of the roller.

Figure 3:
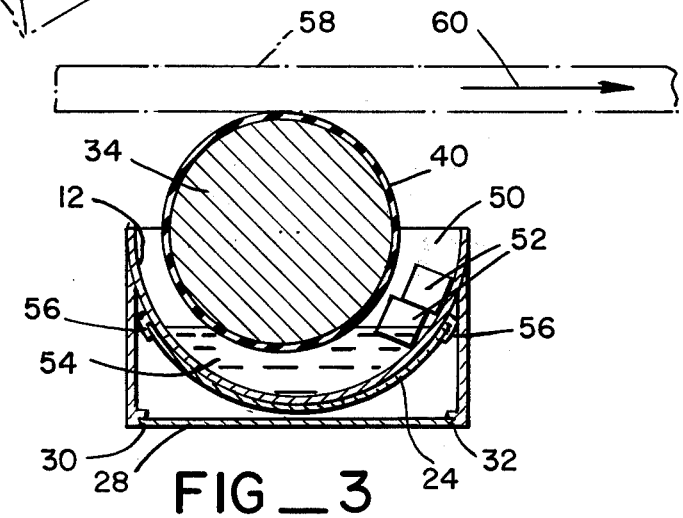
FIG. 3 is a side elevation cross sectional view of the hot waxing apparatus.

The operation of the apparatus 10 of the present invention is more fully illustrated by way of reference to FIG. 3. When roller 34 is mounted to tub 12 by placing the struts such as 36 in the corresponding slots such as 20, the lower half of roller 34 will project into tub 12 and the upper half will be exposed. Slots 20, 22 in side walls 16, 18 of tub 12 are slightly offset so that a relatively large gap 50 is provided between roller 34 and one of the sides of the tub. Hot wax ordinarily comes in cubes such as 52 which can easily be dropped through slot 50 to the bottom of tub 12. Heating sheet 24 is wrapped around the exterior radial surface of tub 12 and will melt wax cubes 52 at the appropriate uniform temperature so that a supply of melted wax 54 is provided in the bottom of tub 12. Clips 56 are provided so that heater 24 is demountably attached to tub 12. When lower plate 28 is removed, heater 24 can be removed and replaced so that the apparatus 10 can be used even when heater 24 malfunctions, and different temperature heaters can be employed for waxes having different characteristics.

The lower surface of covering 40 projects into melted wax 54. When a ski such as 58 is rolled over the upper surface of covering 40 at a constant speed as illustrated by arrow 60, a uniform layer of wax from supply 54 will be applied to the bottom of ski 58. As discussed previously the softness of covering 40 is preselected so that the coating of wax will be uniformly applied to the bottom of ski 58.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What I claim as new is:

1. Apparatus for applying hot wax to the bottom of skis, said apparatus comprising:

an upwardly opening heat conductive tub having a substantially semi-cylindrical configuration and planar end walls and defining a chamber adapted to contain ski wax;

a cylindrical roller having oppositely directed axial struts adapted to engage the respective end walls of the heat conductive tub so that the roller is rotably mounted on said end walls of said tub and the lower portion only of the radial surface of the roller projects into the tub, the radial surface of said roller and the axial struts being constructed of heat conductive material and said roller including heat conducting means connecting the axial struts with said radial surface so that a preselected portion of the heat from the end walls of the tub is conducted through the axial struts to the radial surface of the roller;

a resilient, deformable silicone rubber covering mounted on the radial surface of the cylindrical roller, for picking up wax from said tub and applying it to the bottom of a ski in contact with said covering, said covering being about one-eighth of an inch thick, said dimension being critical in maintaining the proper temperature at the point of contact of said ski with said covering, said covering further having a softness in the range of 30 to 50 durometers inclusive, said softness in combination with said thickness of one-eighth of an inch acting in combination to press wax picked up from said tub into the pores of the bottom surface of said ski as it moves past the point of contact with said covering, said roller being further provided with raised shoulders to prevent said covering from directly contacting said end walls; and a two-dimensional heater mounted to the exterior surface of the tub and adapted to heat the ski wax in the tub to about 250°–300° F to melt the wax without substantially altering its chemical composition and to heat said covering by conduction of a preselected portion of the heat from the heater through the end walls of the tub, the struts and said heat-conducting means to substantially 200°–225° F to open the pores in the bottom of a ski passing over said covering so the hot wax will be applied to the bottom of the ski uniformly across its entire surface to uniformly fill the pores in the bottom of the ski.

2. Apparatus as recited in claim 1 wherein the cylindrical roller comprises a solid aluminum roller.

3. Apparatus as recited in claim 1 wherein the covering comprises silicone rubber having a durometer rating in the range of 40 to 45 inclusive.

4. Apparatus as recited in claim 1 wherein the interior radial surface of the tub is provided with a Teflon coating so that solidified wax can easily be removed after the system has been used.

5. Apparatus as recited in claim 4 wherein the heater comprises a two-dimensional heating sheet adapted to be maintained at a constant temperature, said sheet generally spanning the length of the tub in the axial direction so that wax in the tub will be subjected to a uniform melting temperature.

6. Apparatus as recited in claim 5 wherein the aluminum roller is mounted to the end walls of the tub so that the axis of the roller is offset to one side of the axis of the semi-cylindrical tub to provide a relatively large gap between the radial surface of the roller and the tub at one side of the roller to allow for insertion of wax cubes into the tub.

* * * * *